United States Patent [19]

Kobayashi et al.

[11] Patent Number: 4,507,090

[45] Date of Patent: Mar. 26, 1985

[54] PROPELLING UNIT SUPPORT STRUCTURE FOR OUTBOARD ENGINES

[75] Inventors: Hidetaka Kobayashi; Akiyoshi Kinpara, both of Hamamatsu, Japan

[73] Assignees: Yamaha Hatsudoki Kabushiki Kaisha; Sanshin Kogyo Kabushiki Kaisha, both of Japan

[21] Appl. No.: 342,221

[22] Filed: Jan. 25, 1982

[30] Foreign Application Priority Data

Jan. 27, 1981 [JP] Japan ..... 56-11169

[51] Int. Cl.[3] ..... B63H 21/30

[52] U.S. Cl. ..... 440/52; 248/640

[58] Field of Search ..... 440/52, 111, 900; 248/609, 635, 640, 659; 267/63 R, 63 A, 140.3, 141, 141.1, 141.2, 153; 384/215

[56] References Cited

U.S. PATENT DOCUMENTS

| | | | |
|---|---|---|---|
| 2,916,007 | 12/1959 | Kiekhaefer | 440/52 |
| 3,002,489 | 10/1961 | Watkins | 440/52 |
| 3,259,099 | 7/1966 | Kiekhaefer | 440/111 |
| 4,044,977 | 8/1977 | Feucht | 267/153 |
| 4,286,777 | 9/1981 | Brown | 248/635 |
| 4,392,640 | 7/1983 | Kakimoto | 267/141.2 |

FOREIGN PATENT DOCUMENTS

| | | | |
|---|---|---|---|
| 53-25350 | 6/1978 | Japan | 440/52 |

*Primary Examiner*—Trygve M. Blix
*Assistant Examiner*—Rodney Corl
*Attorney, Agent, or Firm*—Ernest A. Beutler

[57] ABSTRACT

Several embodiments of resilient supports for outboard motors embodying a relatively soft elastomeric element for damping low magnitude loads and a relatively hard elastomeric element that is loaded upon large magnitude relative movements. In some embodiments the loading arrangement is such that the softer resilient element is operative over a larger range of relative movement in one direction than in the other. In one embodiment an arrangement is employed wherein the elastomeric elements need not be bonded to their loading elements. In all embodiments the vertical support is only provided through the softer elastomeric element.

15 Claims, 9 Drawing Figures

PROPELLING UNIT SUPPORT STRUCTURE FOR OUTBOARD ENGINES

BACKGROUND OF THE INVENTION

This invention relates to a supporting arrangement for an outboard drive unit and more particularly to an improved resilient support for such a unit.

As is well known, it is common practice to mount outboard drive units on the hull of a water craft. In arrangements of this type, it is desirable to provide some form of resiliency in the mounting so that vibrations from the propeller and/or engine will not be transmitted back to the hull. However, if a resilient supporting structure is employed that is sufficiently flexible so as to accommodate low speed vibrations, too much resiliency may be introduced into the system and there will be insufficient damping under high speed running or when sudden changes in direction are made. Therefore, it has been the practice to employ relatively rigid shock absorbers between the propelling unit and the hull so as to achieve damping and reduce the transmission of vibrations under high speeds or when rapid changes in direction are made. Thus, previously proposed systems have not provided adequate softness under low speed running conditions. In addition to the wide range in magnitude of vibrations which must be absorbed in outboard propelling units, the vibrations occur in different directions. Vibrations in one direction may require significantly different damping than the vibrations which occur in other directions.

It is, therefore, a principal object of this invention to provide a supporting structure for an outboard propelling unit that is effective throughout a wide speed and load range.

It is a further object of the invention to provide a propelling unit suspension system that offers relatively soft characteristics under some conditions and yet will provide resiliency damping under significantly different conditions.

In conjunction with the provision of resilient mounting arrangements for outboard drive units, it has been proposed to use an elastomeric arrangement wherein an elastomer element is bonded to metal fixtures that are in turn affixed relative to the hull and the propelling unit. It is essential that the bonding between the elastomer and metal be extremely reliable to insure against failure in use. However, in order to achieve this bonding, a high degree of quality control must be insured which adds to the cost of the supporting structure.

There has been proposed an arrangement wherein an elastomeric sleeve is closely fitted and clamped within the inner and outer metal sleeves so as to avoid the necessity of a bonding arrangement. Such an arrangement is shown in Japanese utility model application No. 48-11550. With such arrangements, however, it is necessary to provide high compressive loads which result in the provision of a relatively rigid, even though elastic, support. Hence, such arrangements as heretofore proposed have not provided any significant damping for low speed vibrations.

It is, therefore, a further object of this invention to provide an improved supporting structure for outboard propelling units that may be made at a lower cost and yet will be effective throughout wide speed and load ranges.

SUMMARY OF THE INVENTION

A first feature of this invention is adapted to be embodied in an arrangement for suspending an outboard propelling unit upon the hull of a water craft and for dampening vibrations associated therewith, and comprises a drive unit and means for mounting the drive unit upon the hull for steering movement about a generally vertically extending axis. The mounting means includes first and second resilient means interposed between the drive unit and the hull. The first resilient means has a substantially lower rate than the second resilient means. In accordance with the invention, means are provided for loading the resilient means upon relative movement between the drive unit and the hull so that the first resilient means only is effective to dampen vibrations upon small magnitude relative movement and the second resilient means is effective to dampen vibrations upon larger relative movements.

Another feature of the invention is adapted to be embodied in a suspension unit having two resilient means of different rates interposed between a drive unit and the hull. In accordance with this feature of the invention, means are provided for loading one of the resilient means upon relative movement in one direction and the other resilient means upon relative movement in another direction.

DETAILED DESCRIPTION OF THE PREFERRED EMBODIMENTS

Figure 1:
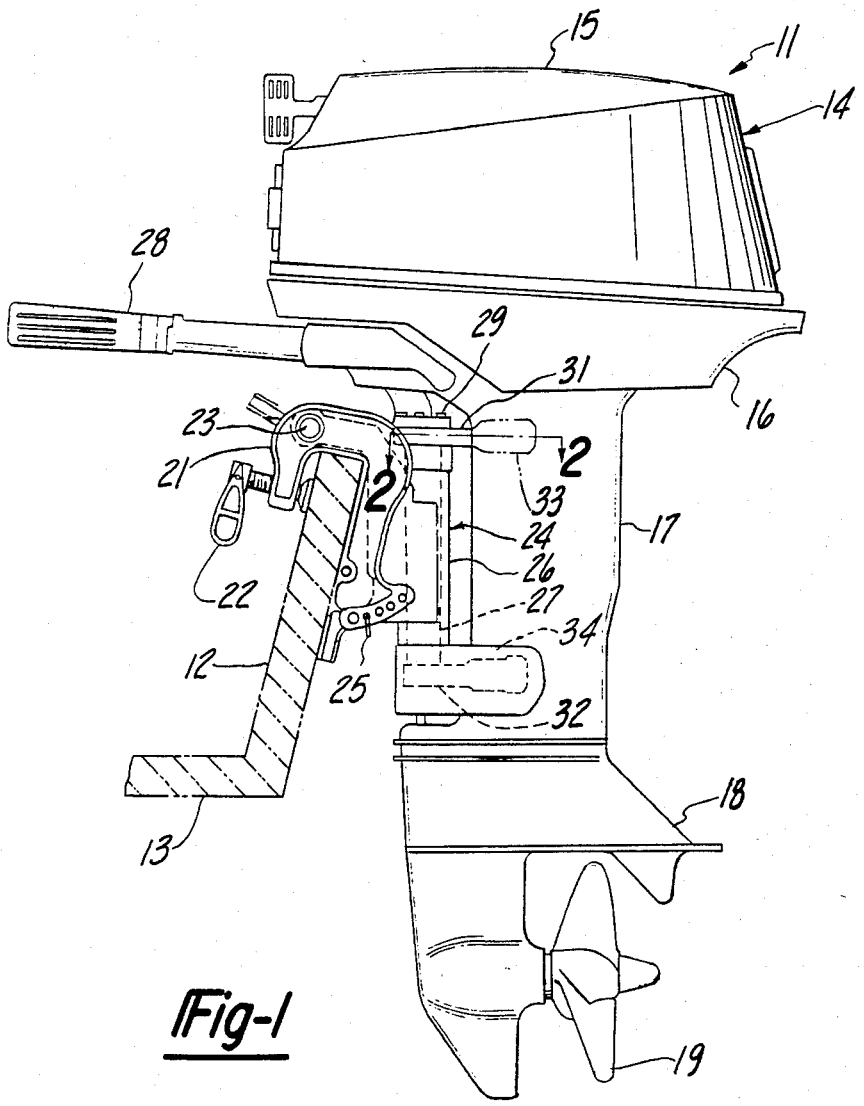
FIG. 1 is a side elevational view of an outboard engine constructed in accordance with a first embodiment of the invention but is typical of all embodiments.
Figure 2:
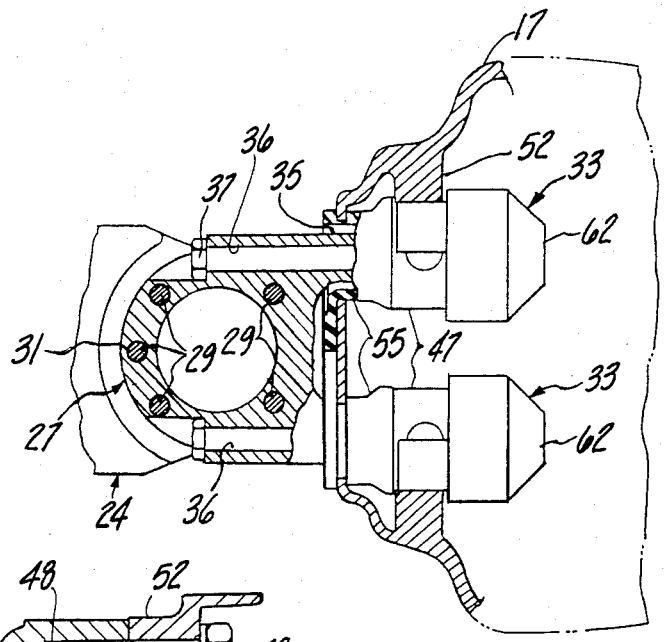
FIG. 2 is an enlarged cross-sectional view taken generally along the line 2—2 of FIG. 1 and showing certain of the components in elevation.

FIG. 1 is a partial side elevational view which may be considered to be typical of all of the disclosed embodiments. Before turning to a detailed description of each of the embodiments, the general over-all configuration will be described by reference to this figure.

A propelling unit, indicated generally by the reference numeral 11, is illustrated which, in accordance with the illustrated embodiments of the invention, comprises an outboard motor that is adapted to be mounted, in a manner to be described, on a transom 12 of the hull 13 of a watercraft which is shown in phantom. The outboard motor 11 consists of a power head, indicated generally by the reference numeral 14, that includes an internal combustion engine which is concealed within a cowling 15 and lower tray 16 in a known manner. The power head 14 drives a drive shaft (not shown) which is contained within a drive shaft housing 17 and which, in turn, delivers the drive to a lower unit 18 for rotating a propeller 19 in a known manner.

The outboard motor 11 has a clamping bracket 21 that is affixed to the hull 12 by means of screw assemblies 22. A pivot pin 23 is carried by the clamping bracket 21 and supports a swivel unit, indicated generally by the reference numeral 24, for tilting movement of the power head 14, drive shaft housing 17 and lower unit 18 about a horizontally disposed axis as defined by the pivot pin 23.

The swivel bracket 24 is engageable with a tilt rod assembly 25 that is engageable in a selected one of apertures in the clamping bracket 21 so as to set the trim angle of the outboard motor 11 relative to the transom 12. The swivel bracket 24 has an integral bearing portion 26 in which a steering shaft 27 is supported for pivotal movement about a generally vertically extending axis in a known manner. A handle 28 is affixed to the steering shaft 27, as by means of bolts 29, so as to permit steering movement as is well known.

The power head 14, drive shaft housing 17 and lower unit 18 are affixed to the steering shaft 27 by means of an upper coupling 31 and lower coupling 32. The couplings 31 and 32 are affixed to the drive shaft housing 17 by means of upper and lower resilient connections 33 and 34 in accordance with various embodiments of the invention.

In each embodiment, as to be hereafter described, the resilient connections at the upper and lower ends are the same and for that reason only the construction of the upper end, as typified by the cross-sectional view taken along the line 2—2, will be described in detail for each embodiment. Except for the construction of the resilient connection 33 and 34 as will be described in the following embodiments, the construction heretofore described may be considered to be typical of the prior art type of constructions and for that reason a description of the conventional components has not been given.

EMBODIMENTS OF FIGS. 2 THROUGH 4

Figure 3:
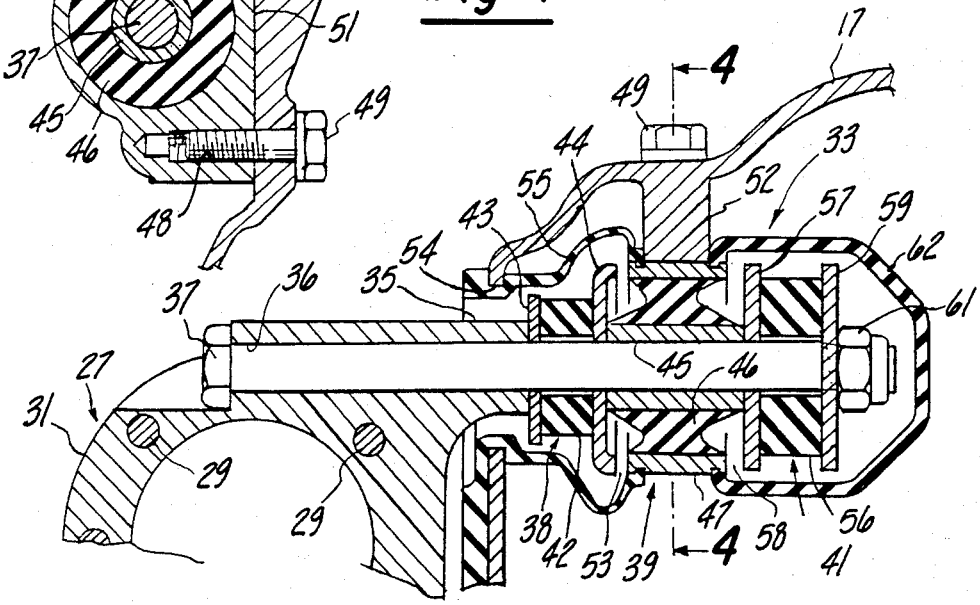
FIG. 3 is a further enlarged, partial cross-sectional view taken along the line 2—2 of FIG. 1 and shows all of the elements in cross section.

The upper coupling 31 is formed integrally with the steering shaft 27 and has a pair of rearwardly extending cylindrical projections 35. Bores 36 extend through the coupling 31 and its projections 35 and receive bolts 37 that effect the connection through the resilient connection 33 to the drive shaft housing 17 in a manner best shown in FIGS. 3 and 4.

In this embodiment each of the resilient couplings 33 and 34 consist of a first elastomeric element, indicated generally by the reference numeral 38; a second elastomeric element, indicated generally by the reference numeral 39; and a third elastomeric element, indicated generally by the reference numeral 41. The first elastomeric element 38 is comprises of an annular elastomer member 42 that is bonded to a washer-like metallic piece 43 that is abuttingly engaged with the end of the coupling projection 35. The opposite end of the elastomer member 42 is bonded to a generally cup-shaped metallic member 44 that is slightly larger in diameter than the washer 43 and which is slideable on the bolt 37.

Figure 4:
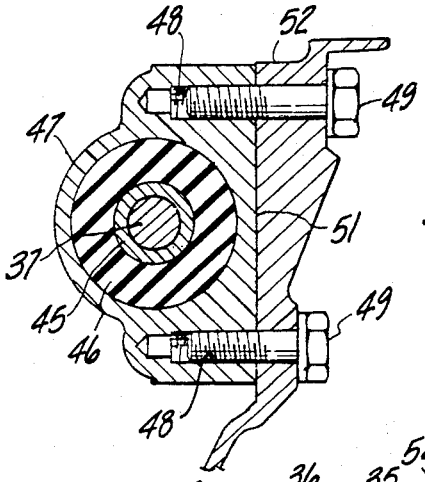
FIG. 4 is a cross-sectional view taken along the line 4—4 of FIG. 3.

The washer 44 of the elastomeric element 38 is abuttingly engaged with a metallic inner sleeve 45 of the second elastomer element 39. The outer portion of the sleeve 45 is bonded to an elastomer member 46. The outer portion of the elastomer member 46 is bonded to the interior of an outer metallic sleeve 47. The sleeve 47 has a pair of bosses in which tapped openings 48 are formed (FIG. 4). Bolts 49 are received in the openings 48 and rigidly affix a face 51 of the sleeve 47 to a projection or boss 52 formed integrally with the drive shaft housing 17. It should be noted that the outer sleeve 47 is shorter in length than the inner sleeve 45 and that a clearance 53 exits normally between the washer 44 and the outer sleeve 47.

The coupling projections 35 extend through apertures 54 in the forward portion of the drive shaft housing 17. A elastomer seal 55 extends around the sleeve 47 and engages the drive shaft housing in the vicinity of the apertures 54 so as to prevent the escape of exhaust gases from the interior of the drive shaft housing 17 to the atmostphere.

The third elastomeric element 41 includes an annular elastomer member 56 that has one of its faces bonded to a metallic washer 57. The washer 57 is abuttingly engaged with the inner sleeve 45 of the elastomer element 39 and is spaced from its outer sleeve 47 by a gap, indicated by the reference numeral 58. The opposite end of the elastomer member 56 is bonded to a second metallic washer 59. A nut 61 on the end of each bolt 37 holds the elastomer elements 38, 39 and 41 in stacked relationship with the desired amount of preload on the elastomer members 42 and 56. A sealing boot 62 encircles the end of the sleeve 47 opposite that engaged by the seal 55 and surrounds the elastomer element 41 so as to complete the sealing of the interior of the drive shaft housing 17 from the atmosphere.

The elastomeric member 39 has a lower rate or lower effective modulus of elasticity than the elastomer members 38 and 41. Because of the manner in which the couplings 33 and 34 are arranged, during low speed running of the engine, its support will be solely through the elastomeric member 39. Thus, a relatively soft connection is afforded that effectively damps the smaller vibrations which occur under this running condition. When, however, the engine is running at a higher speed, the thrust transmitted through the drive shaft housing 17 will cause the outer sleeve 39 to move rearwardly closing the gap 58 and affording a direct mechanical connection between the outer sleeve 47 and the washer 57 of the elastomeric member 41. Thus, under forward running conditions a relatively stiffer connection will be afforded that provides some damping and yet is capable of maintaining an effective driving and steering connection.

Under reverse operation, the drive shaft housing 17 will move in a forward direction relative to the coupling 27 and the gap 53 will be closed so that the outer sleeve 47 abuttingly engages the washer 44 of the elastomeric member 38. Again, a relatively stiffer connection will be afforded. This provides effective damping when travelling rapidly in reverse.

it should be noted that the gap 58 is larger than the gap 53 so that the softer elastomeric element 39 has a greater effective range during forward operation. This wider range during forward operation than during reverse operation is chosen because the reverse thrusts normally are considerable lower than the maximum forward thrust.

Even though the contruction of the lower flexible connections 34 are generally the same as those of the upper connections 33 described, the respective clearances are reversed with the lower connections 34. This is done because the forces are transmitted in opposite directions through the upper connections than through the lower connections. That is, when the boat is being driven forwardly, the upper portion of the drive shaft housing 17 moves rearwardly relative to the steering shaft 27 while the lower portion moves forwardly. Thus, the magnitude of the clearance for the connections 34 are reversed from those of the connections 33. In all other regards the construction is the same.

In addition to providing a relatively soft suspension during low speed running, the arrangement of the flexible connections 33 and 34 is such that the vertical vibrations generated by the engine 11 are always damped by the soft elastomeric elements 39. It should be readily apparent that the vertical support provided by the flexible connections 33 and 34 is solely through the soft elastomeric elements 39. However, the thrust loads are taken first through this elastomeric element and then through the more rigid elastomeric elements 38 and 41 depending upon the direction of thrust.

EMBODIMENT OF FIG. 5

Figure 5:
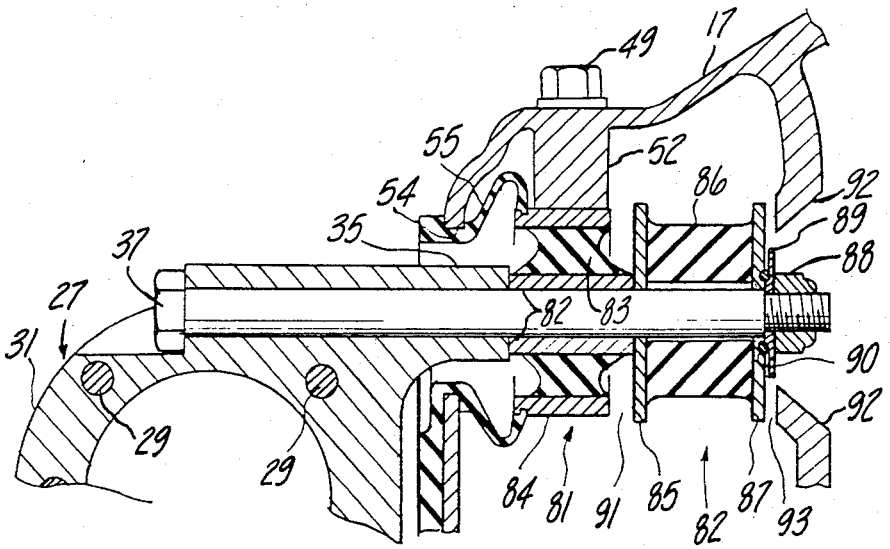
FIG. 5 is a cross-sectional view, in part similar to FIG. 3, showing another embodiment of the invention.

In the previously described embodiment, each of the flexible connections 33 and 34 embodied one hard elastomeric member for taking the forward thrust and a separate hard elastomeric member for taking the rearward thrust. FIG. 5 illustrates an embodiment wherein a single hard elastomeric member takes the thrust at both the forward and reverse directions. Since only the construction of the elastomeric members and the method of their loading differs from the previous embodiment, only this portion of the construction has been illustrated and will be described in detail. Where components of this embodiment are the same as the components of the previously described embodiment, they have been identified by the same reference numerals and will not be described again in detail.

This embodiment employs a relatively soft elastomeric element, indicated generally by the reference numeral 81 and a single, relatively hard elastomeric element 82. The elastomeric element 81 is comprised of an inner sleeve 82 that is slideably supported on the bolt 37. Bonded to the inner sleeve 82 is an elastomer member 37. The outer periphery of the elastomer member 83 is bonded to a bore of an outer sleeve 84, which, as in the previously described embodiment, is fastened to lugs 52 of the drive shaft housing 17 by means of bolts 49. In this embodiment one end of the inner sleeve 82 is abuttingly engaged with the coupling projection 35.

The opposite end of the inner sleeve 82 is abuttingly engaged with a washer 85 that is bonded to an annular elastomer member 86 of the element 82 and which is slideable on the bolt 37. The opposite end of the elastomeric member 86 is bonded to another washer 87 which is slideably supported upon the bolt 83. A nut 88 engages a washer 89 to urge it and an O-ring seal 90 against the washer 87.

A gap 91 exists between the outer sleeve 84 and washer 85 due to the fact that the outer sleeve 84 is considerably shorter in length than the inner sleeve 82. The drive shaft housing 17 is also formed with a pair of inwardly extending lugs 92 that are spaced from the washer 87 by a gap, indicated at 93. The gap 93 is shorter in length than the gap 91 so that the softer elastomeric element 81 will operate through a wider range during forward travel than during rearward travel, as will be described.

In this embodiment, when there is a forward driving thrust, the drive shaft housing 17 will move to the right as viewed in the figure, remembering again that the movement will be in the opposite direction with respect to the lowermost connections. The elastomer member 84 will yield and provide relatively soft vibration damping. Eventually, there will be sufficient movement for the clearance 91 to be taken up and the outer sleeve 84 will directly engage the washer 85. When this occurs, further damping will be provided by the elastomeric member 86 at a higher rate.

If the boat is travelling in reverse, the outer sleeve 84 of the elastomeric element 81 will be shifted to the left as viewed in FIG. 5 and initial damping will be at a relatively soft rate as provided by this element. Under high magnitude loadings, the lugs 92 will have moved sufficiently to take up the clearances 93 and the washer 87 of the elastomeric element 82 will be contacted. Further damping under this condition will be provided by the harder elastomeric element 82. As in the previously described embodiment, the gap 91 is larger than the gap 93 so that the softer elastomeric element 81 will be operative over a wider range in travelling in the forward direction than in the reverse direction. Again, the size of the gaps 91 and 93 is reversed with respect to the lowermost connections. In this embodiment, the softer elastomeric elements 81 provide all of the vertical loading while both elements 81 and 82 are effective to absorb the thrust loadings.

EMBODIMENT OF FIG. 6

Figure 6:
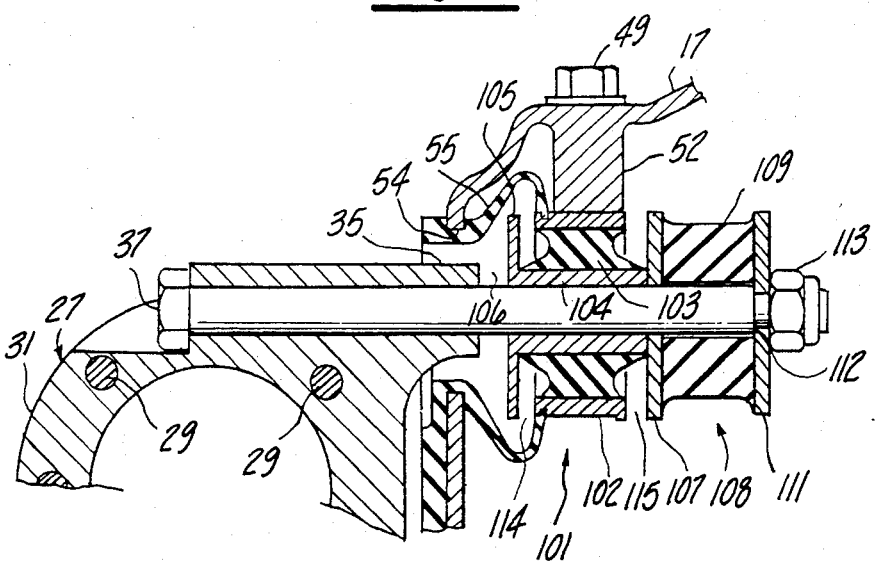
FIG. 6 is a cross-sectional view, in part similar to FIGS. 3 and 5, and shows a still further embodiment of the invention.

FIG. 6 illustrates yet another embodiment of this invention wherein a single hard shock absorber is employed for providing damping in both the forward and reverse directions. Unlike the embodiment of FIG. 5, this is achived with this embodiment without necessitating the formation of additional lugs or projections on the drive shaft housing.

In this embodiment a first relatively soft elastomeric element 101 has an outer sleeve 102 that is affixed, as with the previously described embodiments, to lugs 52 on the drive shaft housing 17 by bolts 49. An elastomer member 103 of annular configuration has its outer periphery bonded to the sleeve 102 and its inner periphery bonded to an inner sleeve 104 which is slideable on the bolt 37. In accordance with this embodiment, one end of the sleeve 104 is provided with a radially outwardly extending projection 105 that is spaced, in the normal condition, from the end of the drive shaft housing projection 35 by a gap, indicated by the reference numeral 106.

The opposite end of the inner sleeve 104 is affixed, as by welding, to a washer 107 of a second, relatively hard elastomeric element, indicated by the reference numeral 108. The washer 107 is slideably supported upon the bolt 37 and is affixed as by bonding to an elastomeric member 109 that is relatively hard in relation to the elastomer member 103. The opposite end of the elastomer member 109 is affixed as by bonding to a second washer 111. The washer 111 is abuttingly engaged with a shoulder 112 of the bolt 37 and is held in this engagement by a nut 113. In this embodiment the bolt 37 is fixed against axial movement relative to the coupling 31 in any suitable manner.

The outer sleeve 102 of the elastomeric element 101 is spaced from the outwardly extending projection 105 of the inner sleeve 104 by a gap 114. The opposite end of the outer sleeve 102 is also spaced from the washer 107 by a gap 115. In accordance with this embodiment, the gap 115 is larger than the gap 114.

When the engine, in accordance with this embodiment, is driving the boat forwardly, the outer sleeve 102 of the elastomeric element 101 will initially deflect toward the right. Thus, as with the previously described embodiments, when travelling at low speeds, a relatively soft damping will be afforded. Under higher speeds and loadings there will be sufficient deflction as to take up the gap 115 and have direct engagement between the outer sleeve 102 and washer 107. Additional damping will, therefore, be provided at a higher rate by the more rigid elastomeric element 108.

When the motor is driving the boat rearwardly in this embodiment, the outer sleeve 102 will be deflected toward the left and, again, initial damping will be accomplished by the relatively soft elastomeric element 101. Once the gap 114 has been eliminated, the outer sleeve 102 will engage the inner sleeve projection 105 and cause the inner sleeve to be moved to the left. This movement will be transmitted to the washer 107 which is affixed to the inner sleeve and a tensile load will be exerted on the elastomer member 109 to resist further deflection at a higher, harder rate. In this embodiment the elastomeric element 108 acts in both compression and tension.

As with the previously described embodiments the relative sizes of the gaps 114 and 115 are reversed at the lowermost flexible connections and the elastomeric elements 101 provide the sole vertical support and damping.

EMBODIMENT OF FIGS. 7 THROUGH 9

Figure 7:
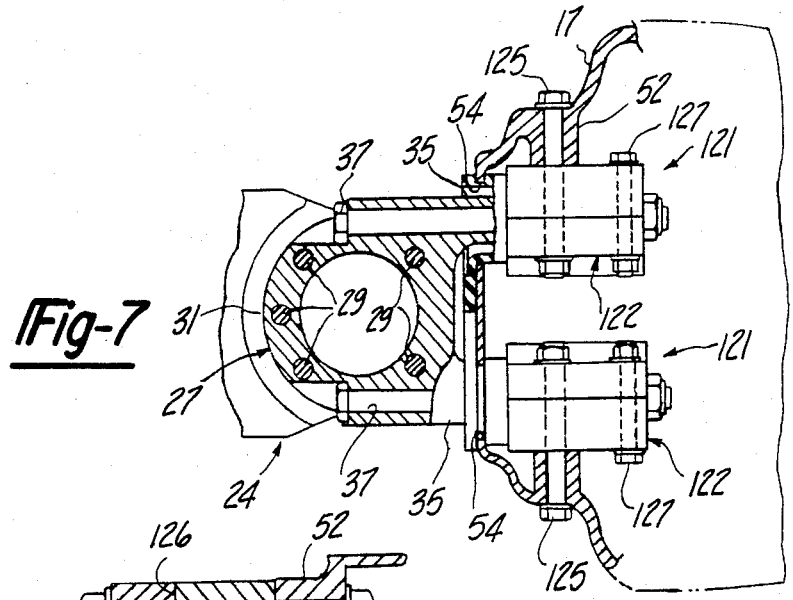
FIG. 7 is a cross-sectional view, in part similar to FIG. 2, and shows a still further embodiment of the invention.
Figure 9:
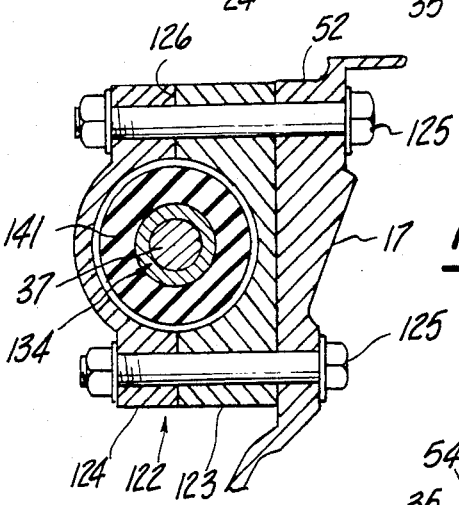
FIG. 9 is a cross-sectional view taken along the line 9—9 of FIG. 8.
Figure 8:
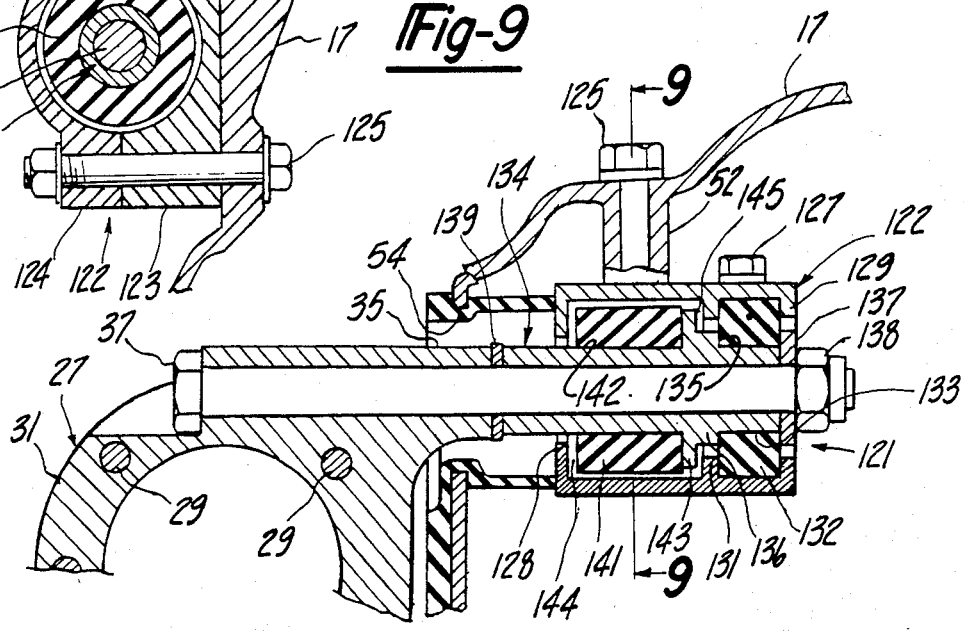
FIG. 8 is a further enlarged, partial cross-sectional view of the embodiment shown in FIG. 7 and is in part similar to the embodiments of FIGS. 3, 5 and 6 in that it shows all of the components in full cross section.

In all of the previously described embodiments, an arrangement has been utilized in which the elastomeric member of each elastomeric element is affixed by bonding to either the inner and outer sleeves or to the end washers. Such an arrangement requires expensive production technique and high degrees of quality control. FIGS. 7 through 9 illustrate an embodiment of the invention wherein such bonding is unncessary and yet it is possible to obtain relatively soft damping under light loads and a harder damping under high loads. As with the previously described embodiments, only one of the flexible connections has been illustrated and will be described in detail. As with the previous embodiments, the construction of the connection elements is substantially the same. However, those positioned at the bottom end of the steering shaft 27 operate in the opposite sense than those to the upper end. Also, with this embodiment components which are the same as those of the previously described embodiments have been identified by the same reference numerals and will not be described again except insofar as is necessary to understand the contruction and operation of this embodiment.

In this embodiment each bolt 37 is affixed to the drive shaft housing 17 by means of a resilient shock absorbing connection, indicated generally by the reference numeral 121. The shock absorbing connections 121 consist of an outer sleeve, indicated generally by the reference numeral 122. In this embodiment the outer sleeve 122 is formed of two halves 123 and 124. The half 123 is engaged with the drive shaft housing bosses 52 and is clamped in that engagement and with the outer half 124 by means of bolt and nut assemblies 125. The sleeve halves 123 and 124 engage along an abutting face 126 (FIG. 9). In addition to the bolt and nut assemblies 125, the sleeve halves 123 and 124 are also clamped together along the face 126 by shorter bolt and nut assemblies 127. The bolt and nut assemblies 127 to not pass through the drive shaft housing bosses 52.

The outer sleeve 122 is formed with radially inwardly extending flanges 128 and 129 at their opposite ends and an intermediate radially inwardly extending flange 131.

A first relatively soft elastomer member 132 is received between and engaged with the flanges 129 and 131 and is clampingly engaged by the outer sleeve halves 123 and 124 with a cylindrical portion 133 of an inner sleeve, indicated generally by the reference numeral 134. The inner periphery of the elastomeric member 132 is clamped between a shoulder 135 formed on the sleeve 134 between the cylindrical portion 133 and an enlarged diameter cylindrical portion 136 and a washer 137. The washer 137 is clamped against the sleeve 134 by means of a nut 138.

The opposite end of the sleeve 134 engages a washer 139 which, in turn, is engaged with the inner end of the coupling projection 35. As a result, the sleeve 134 is fixed axially relative to the coupling 31 and specifically its projection 35.

A second, relatively hard, annular elastomer member 141 is loosely received around a cylindrical portion 142 of the sleeve 138. The radial outer periphery of the elastomer member 141 is spaced inwardly from the outer sleeve 122. One end of the elastomer member 141 is engaged with a shoulder formed by an enlarged cylindrical projection 143 of the sleeve 134. The opposite end of the elastomer member 141 is normally spaced from the outer sleeve flange 128 by a clearance 144. Although the elastomeric member 141 is shown in engagement with the sleeve portion 143 and spaced from the outer sleeve flange 128, it is to be understood that the axial spacings may vary in practice without affecting the operation of the device. The only condition necessary in order to have the device operate satisfactorily, so long as the elastomer member 141 is slideable along the sleeve 134, is that it is shorter in length than the normal distance between the outer sleeve flange 128 and the inner sleeve projection 143.

The inner sleeve projection 143 is normally spaced from the intermediate outer sleeve flange 131 by a gap 145. Also, the inner sleeve cylindrical portion 136 is smaller in diameter than the outer sleeve flange 131 to afford a clearance in this area.

In operation, when the engine is driving the boat in a forward direction, the drive shaft housing 17 will tend to move toward the right as in the previously described embodiments. During this initial movement, the outer periphery of the elastomer member 132 will be shifted to the right while its inner periphery will be held against movement by the washer 137 and shoulder 135 of the inner sleeve. Hence, the relatively soft elastomer member 132 will damp low speed running. As the engine speeds and vibrations increase, however, the deflection of the outer sleeve 122 will be such that its flange 128 will contact one end of the elastomeric member 141 once the clearance 144 has been taken up, and a relatively hard resistance will be exerted in opposition to addition movement.

Considering now the condition when the boat is travelling in reverse, the drive shaft housing 17 will tend to move to the left relative to the steering shaft 27 as viewed in FIG. 8. Again, the initial movement will be resisted at a relatively low rate by the elastomer member 132. The outer sleeve flange 129 will exert a pressure toward the left on the outer periphery of this member while the inner periphery will be held against movement in this direction by the inner sleeve shoulder 135.

Rather then loading the stiffer elastomeric element 141 under extreme reverse condition in this embodiment, the outer sleeve the flange 131 will engage the inner sleeve shoulder 145 and provide a positive stop to further deflections. The soft elastomer member 131 will provide damping under low load and the absence of damping under high loads and reverse is not particularly significant since this is a rarely encountered condition. As with the previous embodiments, the vertical support is all provided by the soft elastomer member 132.

It should be readily apparent that several embodiments of the invention have been disclosed wherein relatively soft damping is provided under low load conditions and yet a stiffer resilient damping will be provided under high loads. Also, in each embodiment of the invention the vertical support for the engine is provided only through a relatively soft elastomer member while the axial thrust loading is achieved at varying rates as aforedescribed. Thus, a softer suspension may be provided for the vertical load than with previously proposed constructions since the vertical load is, in effect, isolated from the thrust loading. Although a number of embodiments have been disclosed, various other changes and modifications may be made without departing from the spirit and scope of the invention, as defined by the appended claims.

What is claimed is:

1. An arrangement for suspending an outboard propelling unit upon the hull of a boat and for dampening vibrations associated therewith comprising a drive unit and means for mounting said drive unit upon said hull for steering movement about a generally vertically extending axis including first resilient means and second resilient means interposed between said drive unit and said hull, said first resilient means having a substantially lower rate than said second resilient means, and means for loading said resilient means upon relative movement of the said drive unit and said hull wherein said first resilient means causes dampening only upon small magnitude relative movements and wherein said second resilient means causes dampening upon large relative movements.

2. A propelling unit support structure as set forth in claim 1 wherein the resilient means comprise elastomer elements.

3. A propelling unit support structure as set forth in claim 1 wherein the means for loading the resilient means includes a lost motion connection.

4. A propelling unit support structure as set forth in claim 3 wherein the loading means affords direct loading of the first resilient means upon small relative movement between the drive unit and the hull and the lost motion connection is interposed in the loading arrangement for the second resilient means.

5. A propelling unit support structure as set forth in claim 4 wherein each of the resilient means is loaded in each direction of relative movement between the drive unit of the hull.

6. A propelling unit support structure as set forth in claim 5 wherein the loading means includes positive stop means for limiting the deflection of the first resilient means in at least one direction to a predetermined amount.

7. A propelling unit support structure as set forth in claim 1 wherein the first resilient means comprises an elastomeric element having an outer sleeve affixed to the drive unit, an inner sleeve affixed to the hull, and an elastomer member interposed between said inner and outer sleeves and loaded upon relative movement therebetween, the second resilient means comprising a second elastomer member having a first portion thereof affixed relative to the hull, the loading means comprising means for moving the outer sleeve into engagement with the second elastomer member for loading the second elastomer member upon a predetermined degree of relative movement between the drive unit and the hull.

8. A propelling unit support structure as set forth in claim 1 wherein the loading means includes positive stop means for positively limiting the deflection of the first resilient means to a predetermined amount.

9. A propelling unit support structure for suspending an outboard propelling unit upon the hull of a boat comprising a drive unit and means for mounting said drive unit upon said hull for steering movement about a generally vertically extending axis including first resilient means and second resilient means interposed between said drive unit and said hull, said first resilient means having a substantially lower rate than said second resilient means, and means for loading said resilient means upon relative movement of the said drive unit and said hull in each direction of relative movement so that said first resilient means only is loaded upon small magnitude relative movements and said second resilient means is loaded upon large relative movements, said loading means affording direct loading of the first resilient means upon small relative movement between the drive unit and the hull and further including a lost motion connection interposed in the loading arrangement for the second resilient means, said loading means being effective to permit a wider range of movement of said first resilient means before loading of said second resilient means in one direction of relative movement than in the opposite direction.

10. A propelling unit support structure as set forth in any one of claims 1 through 9 wherein the means for loading the resilient means is effective to provide all vertical support by the first resilient means and thrust loading through both the first and second resilient means upon sufficient magnitude of relative movement.

11. A propelling unit support structure for suspending an outboard propelling unit upon the hull of a boat comprising a drive unit and means for mounting said drive unit upon said hull for steering movement about a generally vertically extending axis including first resilient means comprising an elastomeric element having an outer sleeve affixed to the drive unit, an inner sleeve affixed to the hull and an elastomer member interposed between said inner and outer sleeves and loaded upon relative movement therebetween, and second resilient means comprising a second elastomer member comprises an annular member having a pair of washers affixed to its opposite ends, one of said washers being affixed to the hull and the other of said washers being engageable with the outer sleeve of the first elastomer element upon a predetermined degree of relative movement for loading said resilient means upon relative movement by the said drive unit and said hull so that said first resilient means only is loaded upon small magnitude relative movements and said second resilient means is loaded upon large relative movements.

12. A propelling unit support structure as set forth in claim 11 wherein the means affixing the first washer and the inner sleeve to the hull comprises a bolt passing through the inner sleeve and affixed to the first washer.

13. An arrangement for suspending an outboard propelling unit upon the hull of a boat comprising a drive unit and means for mounting said drive unit upon said hull for steering movement about a generally vertical extending axis including first resilient means and second resilient means, said resilient means having different rates and means for loading said resilient means whereby only one of said resilient means provides vertical support for said drive unit upon said hull and both of said resilient means are adapted to provide thrust support for said drive unit upon said hull, said loading means loading said resilient means upon thrust movement of the drive unit relative to the hull so that only said first resilient means is effective to dampen vibrations upon small magnitude relative movements and said second resilient means is effective to dampen vibrations upon large relative movements between said drive unit and said hull.

14. A propelling unit support structure as set forth in claim 13 wherein the loading means includes positive stop means for positively limiting the deflection of the first resilient means to a predetermined amount.

15. A propelling unit support structure for suspending an outboard propelling unit upon the hull of a boat comprising a drive unit and means for mounting said drive unit upon said hull for steering movement about a generally vertical extending axis including first resilient means and second resilient means, said resilient means having different rates and means for loading said resilient means whereby only one of said resilient means provides vertical support for said drive unit upon said hull and both of said resilient means are adapted to provide thrust support for said drive unit upon said hull, said loading means including positive stop means for positively limiting the deflection of said first resilient means to a predetermined amount.

* * * * *